US005673810A

United States Patent [19]

Rothrock

[11] Patent Number: 5,673,810

[45] Date of Patent: Oct. 7, 1997

[54] PIT LID COUNTERWEIGHT ASSEMBLY

[75] Inventor: Guy R. Rothrock, Petaluma, Calif.

[73] Assignee: Nova Group, Inc., Napa, Calif.

[21] Appl. No.: 283,573

[22] Filed: Aug. 1, 1994

[51] Int. Cl.[6] ..... B65D 25/00

[52] U.S. Cl. ..... 220/264; 220/484; 49/386

[58] Field of Search ..... 220/324, 264, 220/335, 484; 292/DIG. 17, 99, 121, 198; 49/386, 387; 16/81, 354, DIG. 8; 217/60 R

[56] References Cited

U.S. PATENT DOCUMENTS

| | | | |
|---|---|---|---|
| 83,062 | 10/1868 | Hover | 16/354 |
| 762,741 | 6/1904 | Moos | 16/81 X |
| 768,869 | 8/1904 | Symons . | |
| 980,810 | 1/1911 | McDonald | 220/315 X |
| 1,071,723 | 9/1913 | Flood | 49/387 |
| 1,346,787 | 7/1920 | Kryl . | |
| 1,630,704 | 5/1927 | Kaiser | 49/387 X |
| 2,613,843 | 10/1952 | Suda | 217/60 R |
| 2,625,293 | 1/1953 | Hollerith | 217/60 R |
| 2,629,883 | 3/1953 | Nowell | 217/60 R |
| 3,015,405 | 1/1962 | Sterling | 217/60 R |
| 3,024,549 | 3/1962 | Lubmann | 49/387 |
| 3,047,326 | 7/1962 | Leslie et al. | 292/99 X |
| 3,190,039 | 6/1965 | Carlson . | |
| 3,305,258 | 2/1967 | Peters | 292/198 |
| 3,502,385 | 3/1970 | Stark | 217/60 R |
| 3,541,727 | 11/1970 | Carlson . | |
| 3,838,537 | 10/1974 | Stavenau | 16/354 X |
| 4,065,020 | 12/1977 | Carson . | |
| 4,467,932 | 8/1984 | Dabich . | |
| 4,669,625 | 6/1987 | Armstrong . | |
| 4,729,492 | 3/1988 | Brunner | 220/335 |
| 5,205,073 | 4/1993 | Lyons, Sr. | 49/386 |
| 5,309,676 | 5/1994 | Applemann et al. | 49/386 X |

FOREIGN PATENT DOCUMENTS

| | | | |
|---|---|---|---|
| 76151 | 1/1950 | Norway | 49/387 |

*Primary Examiner*—Steven M. Pollard
*Attorney, Agent, or Firm*—Coudert Brothers

[57] ABSTRACT

A counterweight assembly for a container lid that allows for control over the operating characteristics of the lid during opening and closing. The counterweight assembly is preferably used with a container having one or more walls, a floor, and a lid positioned on top of the walls, the lid being rotatable about a horizontal hinge axis. The counterweight assembly includes a counterweight, and a coupling arm rotatable about a counterweight axis that is located within the container. The counterweight is connected to one end of the coupling arm. The other end of the coupling arm exerts a force against the downward facing surface of the lid.

16 Claims, 5 Drawing Sheets

PIT LID COUNTERWEIGHT ASSEMBLY

BACKGROUND OF THE INVENTION

1. Field of the Invention

The present invention relates to a counterweight assembly for a heavy lid for an enclosure, and more particularly to a counterweight assembly for use on lids of subsurface pits used on airport aprons to provide fuel and other utilities to aircraft during servicing.

2. Description of the Prior Art

Subsurface enclosures typically require strong, heavy lids in order to prevent collapse when the weight of persons or machinery are placed on the lids. A common use for such enclosures is in aircraft servicing where subsurface enclosures are used on airport aprons to provide fuel or other ground support functions. The lids of subsurface enclosures on airport aprons must be large enough to allow maintenance personnel to enter the enclosures and structurally strong enough to allow aircraft to roll across the closed lids without damage or excessive deformation. This results in lids that weigh much more than a person can lift. It is undesirable to use cranes, hoists, or other lifting tools to lift such lids. Consequently, the lids are counterweighted to allow single-handed opening. Counterweight mechanisms for the heavy lids of subsurface enclosures used in the servicing of aircraft are well known. See, for example, U.S. Pat. Nos. 4,467,932 and 4,669,625.

Significant problems still remain with such mechanisms. Although typical lid specifications call for a certain maximum lift force in order to open the lid, prior art counterweight mechanisms fail to meet these specifications. With the counterweight mechanism shown in U.S. Pat. No. 4,669,625, for example, control over the hand force required to move the lid is limited to the length of the leverarm of the mechanism, weight of the counterweight, the initial angular position of the counterweight and the gear ratio. The ability of this mechanism to meet predefined operating criteria is severely limited. Such operating criteria may include not only enabling the lid to be opened with a relatively low hand force, but also enabling the lid to be self closing when the lid is below a specified angular position and self opening when the lid is above a different specified angular position. It may also be necessary to specify a different maximum hand force that is needed before the lid can be closed. Significant safety problems can result if such criteria cannot be designed into the counterweight mechanism's operation. For example, if the force required to close the lid isn't high enough, the lid could slam closed due to wind or jet blast. If the lid becomes more difficult to move as the lid is raised, the lid may be dangerous to operate because users that have begun to lift the lid successfully may have difficulty causing the lid to reach a fully upright position.

Subsurface enclosures of the type used in servicing aircraft also must often operate in harsh environments and be able to withstand the effect of dirt and debris that can get into the subsurface enclosure. Prior art counterweight mechanisms have been prone to fail in such circumstances and cause the lids to freeze closed, a significant safety hazard when quick access to an aircraft pit is needed. Placement of lid hinges within subsurface enclosures also contributes to the entry of dirt and debris into the enclosure, thereby jeopardizing the operation of the lid counterweight mechanism. Such placement is required because the lid opening force is applied as a moment upon the lid hinge using a fixed or rigid connection between the lid and the counterweight mechanism.

Accordingly, there is a need for a counterweight assembly that reduces the disadvantages of prior art counterweight mechanisms.

SUMMARY OF THE INVENTION

In accordance with the present invention, a counterweight assembly for a container lid is provided that overcomes the above identified problems of prior art mechanisms by enabling much greater control over the operating characteristics of lid opening and closing.

The present invention is applicable to a container having one or more walls, a floor, and a lid positioned on top of said one or more walls, wherein the lid is rotatable about a horizontal hinge axis. The present invention encompasses a counterweight assembly for said lid comprising counterweight means and coupling means. The coupling means has a first end and a second end rotatable about a counterweight axis that is located between said first and second ends and within said container, said counterweight axis being parallel to said hinge axis, said first end of said coupling means slidably contacting the underlying surface of said lid such that, as said lid rotates about said hinge axis from a horizontal position to a vertical position, the distance between the point of contact of said coupling means on said lid and the hinge axis is reduced; and means for connecting said counterweight means to said second end of said coupling means.

In a preferred embodiment of the counterweight assembly of the present invention, the second end of said coupling means defines a cam surface, and said means for connecting said counterweight means to said second end of said coupling means comprises flexible link means, said flexible link means positioned on said cam surface so as to create a variable moment arm with respect to said counterweight axis for the force generated by said counterweight as a function of the angular position of the lid.

Accordingly, an object of the present invention is to provide a counterweight assembly for a lid wherein the forces required to move the lid are well controlled.

Another object of the present invention is to enable the moment of force applied to the lid to be varied in a predetermined way as a function of preselected lid operating criteria.

Another object of the present invention is to enable the lid to be opened even if the counterweight assembly is jammed or disabled.

Still another object of the present invention is to reduce the net weight of the counterweight when the lid is nearing a fully open position.

Yet another object of the present invention is to position the lid hinge outside of the subsurface enclosure to minimize the entry of dirt and debris into the enclosure.

These and other objects of the present invention will become apparent to those skilled in the art from the following detailed description of the invention and preferred embodiments, the accompanying drawings, and the appended claims.

BRIEF DESCRIPTION OF THE DRAWINGS

FIG. 1 also shows counterweight assemblies according to the present invention that are located beneath the lid and in the container. For clarity sake, the counterweight assemblies are shown in solid lines, rather than in phantom.

DETAILED DESCRIPTION OF THE PREFERRED EMBODIMENT

Figure 1:
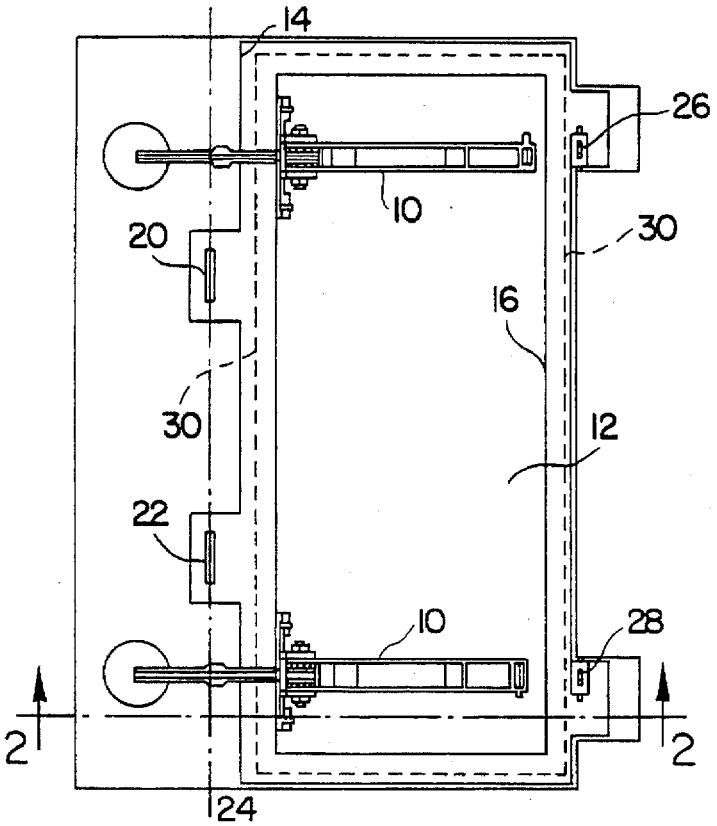
FIG. 1 is a schematic top plan view of a counterweighted access lid in accordance with the present invention.

The present invention encompasses a counterweight assembly for use with a container lid such as the lid shown in FIG. 1. The counterweight assembly according to the present invention enables control over the operating characteristics of the lid as it is opened or closed.

Figure 2:
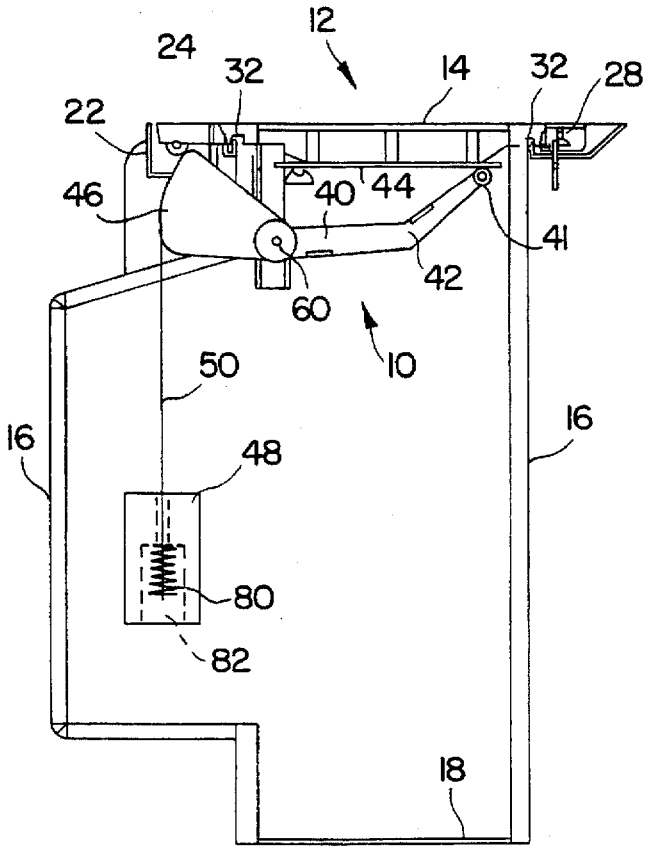
FIG. 2 is a side-sectional view taken along the lines 2—2 of FIG. 1 showing the lid on the subsurface enclosure in its closed horizontal position with the counterweight assembly according to the present invention associated therewith.

A preferred embodiment of a counterweight assembly according to the present invention is shown at 10 in FIG. 2. FIG. 2 illustrates a cross-sectional view of a container 12 having a lid 14, side walls 16, and a floor 18 taken along the lines 2—2 of FIG. 1.

FIG. 1 is a top plan view of lid 14. As seen in FIG. 1, lid 14 is mounted to container 12 preferably using a pair of hinges 20 and 22, such that a horizontal hinge axis 24 for lid 14 is defined. Lid 14 is releasably latched to said container 12 by one or more latches. Two such latches 26 and 28 are shown for lid 14 in FIG. 1.

FIG. 1 also shows counterweight assemblies according to the present invention that are located beneath the lid and in the container. For clarity sake, the counterweight assemblies are shown in solid lines, rather than in phantom.

Typically, container 12 is conventionally prefabricated using fiberglass, a rigid metal, or the like. Container 12 is installed in a suitably excavated hole such that the surface of the surrounding ground or apron is coplanar with the top surface of lid 14.

As can be seen, the top perimeter 30 of container 12 is interior of said hinges 20 and 22 and said latches 26 and 28. This allows container 12 to be sealed from moisture, dust and dirt ingress. Prior art pit lids have hinges that are positioned within the container. Consequently, even when the lid is closed, the slip surfaces of such prior art hinges allow a direct path for moisture and dirt into the pit.

Figure 3:
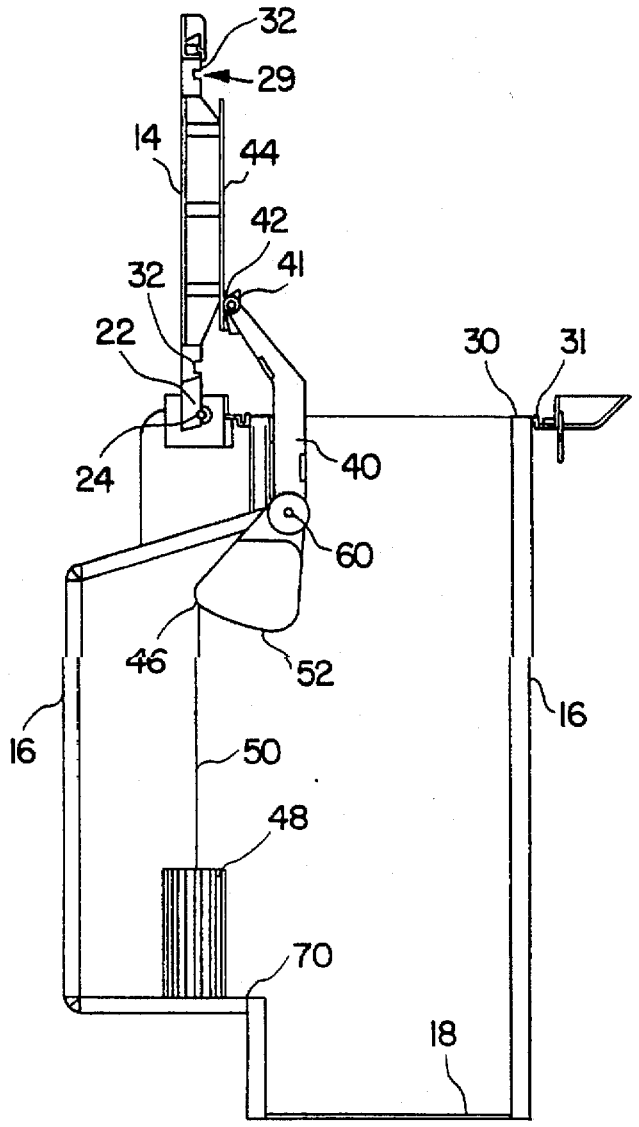
FIG. 3 is a side sectional view similar to FIG. 2 showing the subsurface enclosure lid in its fully-opened position.

In the present invention, as best seen in FIGS. 2 and 3, a conventional gasket or grommet 32 may be added to lid 14 and top perimeter 30 to provide an airtight seal for container 12. As is seen, the gasket or grommet is set into a groove 29 in the lid. Groove 29 follows the full perimeter of the lid. A matching ridge 31 in the top perimeter 30 of container 12 creates a labyrinth or seal. A level and completely airtight container 12 will resist water from entering the container via two mechanisms. First, the grommet may completely seal the path of water from entering the container 12. Second, the effect of a diving bell is created by the grommet groove 29 and the support ridge 31. To enter container 12, water must rise into the groove and pass over the ridge and then pass below the groove. The balance of pressure from the exterior water and the constrained air in the container 12 will limit the amount of water entering the container 12.

The counterweight assembly 10 according to the present invention is shown in FIG. 2 with lid 14 in a substantially horizontal enclosed position in contact with the top perimeter 30 of container 12. FIG. 3 illustrates counterweight assembly 10 with lid 14 in a substantially upright or vertical position. As described in greater detail below, counterweight assembly 10 is designed to enable a person to manually open lid 14 with a relatively low maximum specified hand force, e.g. 25 pounds of force, with lid 14 being strong and heavy enough, e.g. 800 pounds or more, to support the weight of an aircraft or the like on top of the lid. In other words, counterweight assembly 10 acts to balance the weight of lid 14 in a highly controlled fashion to enable safe and easy opening and closing of lid 14 for access to container 12.

Counterweight assembly 10 preferably comprises a coupling means 40 including a first end 42 that is in slidable contact with the underlying surface 44 of lid 14. Coupling means 40 also includes a second end 46. A counterweight 48 is connected to coupling means 40 by a connecting means 50. As seen in FIGS. 2 and 3, as lid 14 is caused to rotate from its horizontal (FIG. 2) to its vertical position (FIG. 3), coupling means 40 rotates about a counterweight axis 60. As can also be seen, as lid 14 is opened, the distance between the point of contact of said coupling means 40 on lid 14 and hinge access 24 is reduced.

Roller 41, at the first end 42 of the coupling means 40, pushes against lid 14 to provide a force to open the lid. The roller and moment arm mechanism are entirely inside the pit. Roller 41 is not rigidly connected to the lid. The position of roller 41 relative to hinge axis 24 is a function of the lid angular position and is variable based upon the geometry of the entire mechanism. Roller 41 causes a variable moment arm as the lid opens. This variable geometry allows greater control of the hand force which is required to open lid 14.

Surface 44 can also have a profile which will allow some "shaping" of the opening hand force versus lid angular position. This provides some further control over the lid position where it is self-closing, neutral or self-opening.

Prior art devices have no such rolling surface, as counterweights are rigidly attached to the lid. Thus, prior art devices do not permit creation of a variable moment arm as a function of the distance between roller 41 and hinge axis 24, nor teach the shaping of the lid surface as a means of controlling the hand force required to open the lid. This new non-rigid coupling of the roller to the lid also allows the lid to be pulled open with assistance if the counterweight mechanism is jammed or disabled. Point 60 is the pivot point for the counterweight moment arm.

Figure 4:
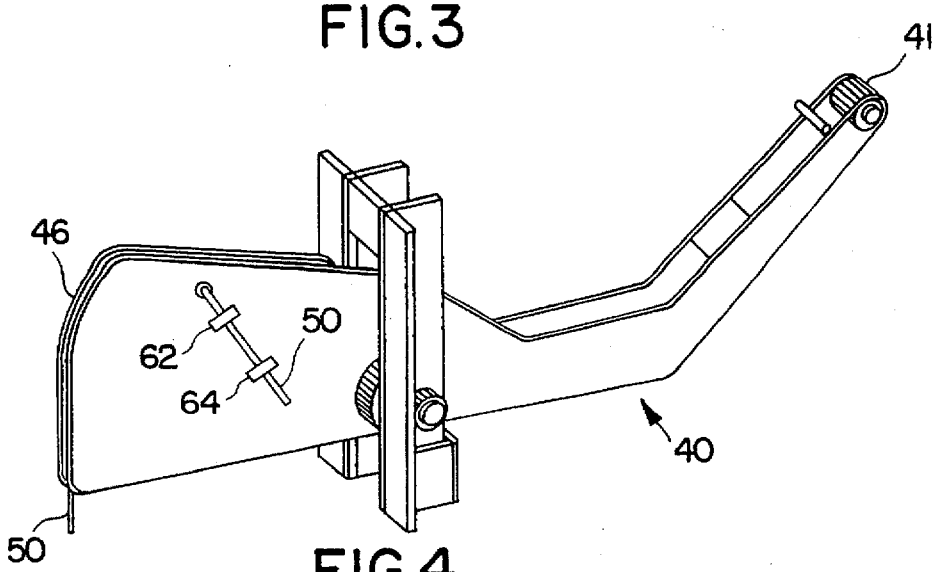
FIG. 4 is a perspective view of a portion of the counterweight assembly according to the present invention illustrating the cam surface of the pulley portion of the coupling means with a cable positioned in a groove formed in said cam surface and connected to a counterweight.

The second end 46 of coupling means 40 defines a cam surface 52. The connecting means 50 comprises a flexible link means. As better shown in FIG. 4, connecting means 50 is fastened to coupling means 40 at points 62 and 64, and contacts the surface 52 of the second end 46 of coupling means 40. This flexible link means is positioned on cam surface 52 so as to create a variable moment arm with respect to counterweight axis 60 for the force generated by counterweight 48 as a function of the angular position of lid 14. In other words, as lid 14 is opened, the moment arm between counterweight axis 60 and lid 14 reduces and increases (both occur, first increasing then reducing) a controlled amount, while the torque created by counterweight 48 at said counterweight axis 60 varies as a function of the angular position of coupling means 40 about said axis 60.

Cam surface 52 is a shaped pulley to which the counterweight is attached. The shape of surface 52 allows control over the resulting moment about point 60. This moment is transferred through the counterweight moment arm to the roller. The subsequent force is exerted by roller 41 upon the surface 44, and the lid.

Spring loaded counterweight 48 provides the balancing force to the weight of the lid. As best shown in FIG. 2, counterweight 48 is attached to connecting means 50 by a spring 80 that is situated in a center shaft 82 of counterweight 48. When counterweight 48 is fully suspended by connecting means 50, spring 80 is in a compressed position due to the weight of counterweight 48.

The spring coupling of connecting means 50 to counterweight 48 allows a further reduction in the net (effective) weight of counterweight 48 at the position where the counterweight 48 lands and rests upon platform 70 as lid 14 nears the full open, or vertical, position. When counterweight 48 is off platform 70, spring 80 is compressed and the full counterweight force is applied to connecting means 50 as a tension force. When counterweight 48 lands upon platform 70, spring 80 decompresses, allowing further movement of connecting means 50 at a reduced tension.

In prior art mechanisms, the counterweight is rigidly attached to the moment arm. The net effect of the counterweight force could only be controlled by its moment arm length and its angular position relative to the angular position of the lid. This was accomplished via gears and the initial angular position of the counterweight moment arm.

The spring loaded counterweight according to the present invention adds the additional effect of the spring to controlling the counterweight force. This is another control to allow the designer to match the counterweight operation to the desired amounts of force necessary to open or close the lid.

Platform 70 is positioned so that counterweight 48 comes to rest when lid 14 is nearly open (e.g., at 75°–80° from the horizontal, closed position). Facilitated by spring 80, this reduces the net counterweight force.

Figure 5:
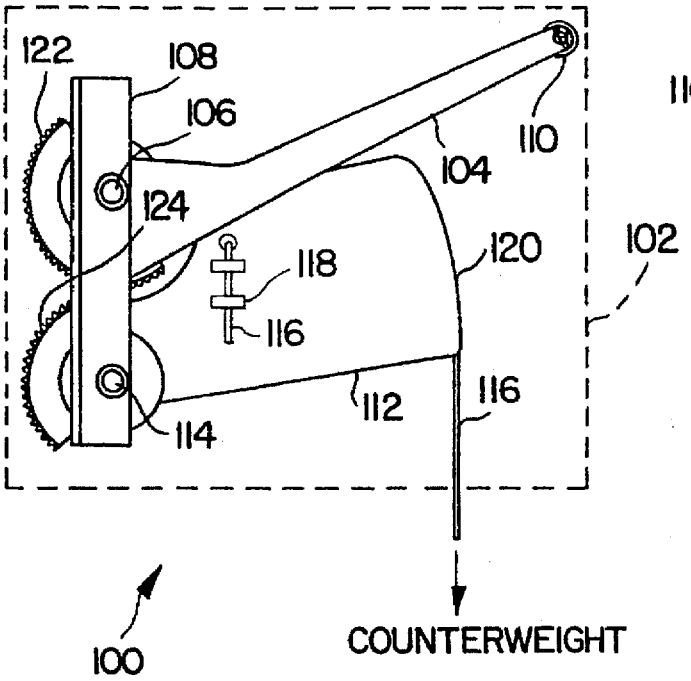
FIG. 5 is a partial side view of an alternative embodiment of a counterweight assembly according to the present invention with the assembly in its position when the lid is closed.
Figure 6:
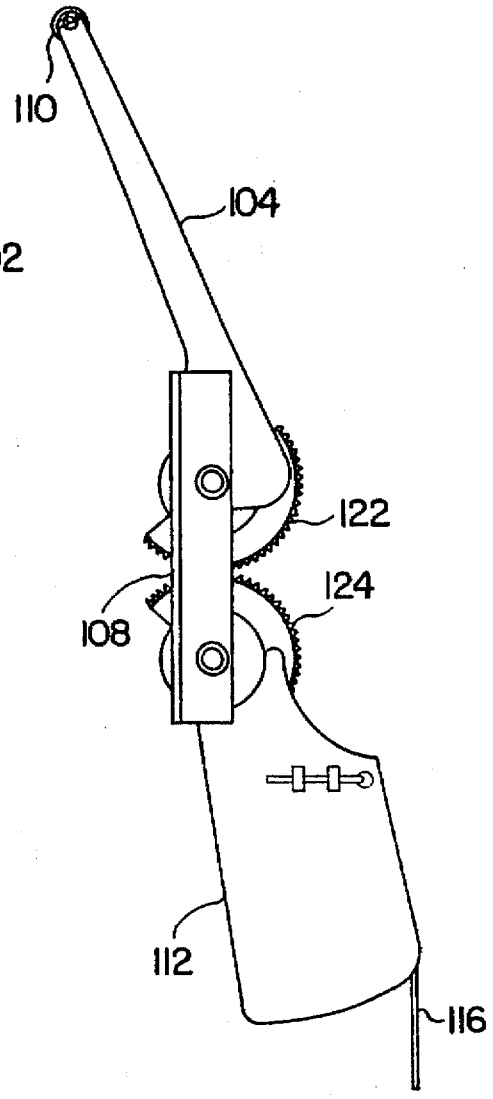
FIG. 6 is a similar view of the alternative embodiment of the counterweight assembly shown in FIG. 5 with the counterweight assembly in its position when the lid is fully opened.

An alternative embodiment of the present invention is shown in FIGS. 5 and 6. FIG. 5 shows a counterweight assembly 100 when a container lid is in a closed position (not shown). Counterweight coupling means 102 includes a first arm 104 rotatable about a first axis 106 passing through a mounting 108. One end of first arm 104 is rotatably attached to mounting 108 at first axis 106. The other end of first arm 104 includes a roller 110 that is in contact with a container lid (not shown).

Counterweight coupling means 102 also includes a second arm 112 counter-rotatable about a second axis 114 through mounting 108. A flexible connecting means 116 is attached to second arm 112 at point 118. Connecting means 116 passes from point 118 over cam surface 120 of arm 112 and is attached to a counterweight (not shown).

Arms 104 and 112 each have geared surfaces, surfaces 122 and 124, respectively, which are in contact such that the gears are enmeshed. Thus, the counterweight attached to connecting means 116 causes surface 124 to exert a force on surface 122 that tends to force roller 110 toward the container lid. As the container lid is opened, arm 112 rotates clockwise and arm 104 rotates counterclockwise due to the force exerted by the counterweight and the interaction of surface 122 and 124. FIG. 6 shows counterweight assembly 100 when the container lid is open.

Turning now to the design of a cam surface for the counterweight assembly shown in FIGS. 1–3 according to the present invention, the design may be completed using the following performance requests and operating constraints:

| | |
|---|---|
| H | Handforce versus angular position of lid<br>This is the force that a person must apply to the lid by hand to cause the lid to open. |
| $\theta$ | Lid angular position about hinge point A. |
| $W_1$ | Lid weight |
| $W_{cw}$ | Weight of counterweight |
| $L_2$ | Roller radius |
| $L_3$ | Length of moment arm |
| X | Horizontal distance between the lid hinge point and the moment arm pivot. |
| Y | Vertical distance between the lid hinge point and the moment arm pivot. |
| L | Distance between the lid hinge point and the center of gravity of the lid. |
| LH | Distance from the center of gravity of the lid to the point of applying the hand force |
| LL | equals L + LH |
| T | Thickness of lid<br>t/2 = vertical distance from the centerline of the hinge point to the center of gravity of the lid when the lid is closed. |
| $X_{L1}$ | Effective moment arm of the counterweight. |
| $\theta_3$ | Moment arm rotation about pivot point B. |

Figure 7:
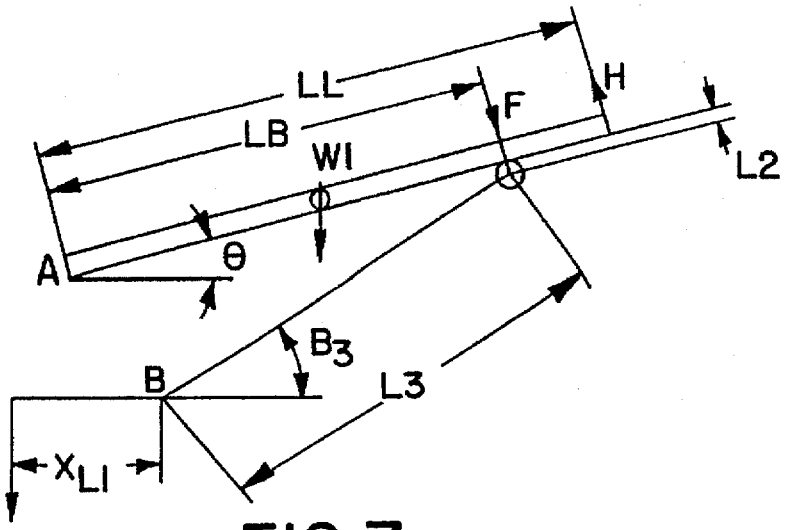
FIG. 7 is a geometrical representation of the forces and moment arms of the subsurface lid and counterweight assembly according to the present invention.

As seen in the schematic diagram of applied forces shown in FIG. 7, the lid rotates about a hinge point A. The moment arm rotates about pivot point B. The opening force of the counterweight/moment arm is F and is applied perpendicular to the lid at a distance $L_{74}$ from the hinge A. The hand force H is applied perpendicular to the lid at a distance LL from A. The radius of the roller at the end of the moment arm is $L_2$ and applies the force F. This results in a constraint that the roller is always in contact with the lid and is perpendicular to the lid. The geometry of the system of linkages and constraints is solved as a function of the lid opening angle $\theta$. The results of the geometry solution is $L_\theta$ and $\theta_3$.

Forces are solved by using the geometry solution and solving the moments =0 about both A and B:

$$M_B-(F\cdot\cos(\theta_2)\cdot L_3-W_{CW}\cdot X_{L1})$$

where $\theta_2=\theta_3-\theta$ $$M_A = W_1\cdot\left(L\cdot\cos(\theta)\cdot SGN+\frac{T}{2}\cdot\cos(\theta+90)\right)-F\cdot L_\theta-H\cdot LL \text{ if}$$

$$\theta<(90-\theta_0) \text{ then } SGN=1 \text{ else } SGN=-1 \text{ where } \theta_0=Atan\left(\frac{\frac{T}{2}}{L}\right)$$

By setting $M_A$ and $M_B$=0, F can be determined from $M_A$=0 and $X_{L1}$ can be determined from $M_B$=0. The results of this calculation determine for a given handforce H has a function of $\theta$ the effective counterweight moment arm $X_{L1}$ and the angle of the moment arm $\theta_3$ for each value of $\theta$.

From this information, the shape of the cam pulley is determined. While determining the shape of the cam would seem straight forward, a cable counterweight has an additional complication. That is, as θ approaches 90° the value of $X_{L1}$ begins to approach zero. The fact that the cam is rotating about pivot point B at nearly a ratio of 1:1 for $\theta_3/\theta$, the effective distance of $X_{L1}$ will be closer to the values at θ=30°–40° as shown in FIG. 8.

This is due to the cam not rotating enough to let the cable clear the larger $X_{L1}$ distance at the smaller values of θ.

For this reason, a compromise is reached by determining the best fit of $X_{L1}$ for each θ and recalculating either the resulting hand force H or a modified counterweight $W_{CW}$ that results for the effective $X_{L1}$. Generally, values of H will be close to the desired values of H for angles of 0° to 70°. But for values of H for angles of 80° and 90° the hand force desired can be used to calculate the reduced counterweight force. A spring and landing platform for the counterweight to rest upon can be used to cause an effective reduction in counterweight force at these two angular positions. The net effect of this compromise is to calculate the shape of the cam pulley and the size of the counterweight spring so that the system operates at approximately the desired hand force H versus the lid opening angle θ.

The cam pulley shape can be determined graphically once the above calculations have been completed. The effective moment arm length and moment arm angular position values calculated for different angles θ, are used to plot vectors. These vectors are used to determine tangent points of the cam. Tangent points are moved as required to reach the compromised shape as discussed above. Finally, the finished profile of the cam pulley orientated for the lid opening angle of 0° and the location of pivot point B relative to the cam pulley profile is obtained.

The spring selection is based upon the calculated counterweight force for θ=80° and 90° and the amount of cable played off the pulley as the cam rotates through its equivalent $\theta_3$ angle. This force versus compressed length of the spring can be used in standard spring equations to select a proper spring.

The effective length of the cam moment arm is determined and found for θ=80° and 90°. Based upon those $X_{L1}$ effective lengths, equation for $M_B=0$ is solved for the $W_{CW}$ needed at 80° and 90°.

The spring will reduce force of the counterweight when the counterweight lands on the platform at <80°. As the moment arm rotates about pivot B, the cable is played off the pulley and since the counterweight now rests on the platform, the spring begins to decompress. The force reduction to the moment arm at 80° is:

$$F_{80}=W_{CW}-W_{CW80}$$

and likewise at 90°

$$F_{90}=W_{CW}-W_{CW90}$$

The distance for the spring to extend is based upon cam geometry. These distances can be approximated by $$D_{80}=\frac{(X_{L1}\cdot 80+X_{L1}\cdot 70)}{2}\cdot(\theta_{3.80}-\theta_{3.70})\text{ where }\theta 3\text{ is in radians}$$

and $$D_{90}=\frac{(X_{L1}\cdot 90+X_{L1}\cdot 80)}{2}\cdot(\theta_{3.90}-\theta_{3.80})+D_{80}$$

Figure 8B:
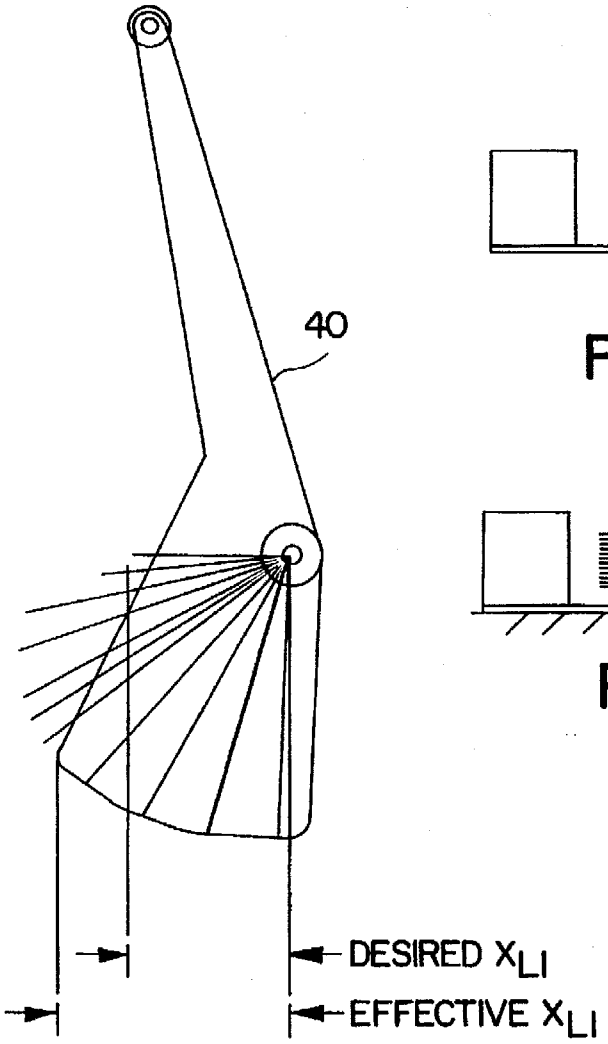
FIG. 8A–8B are geometrical representations of a method by which the cam surface of the coupling means according to the present invention is formed.
Figure 8A:
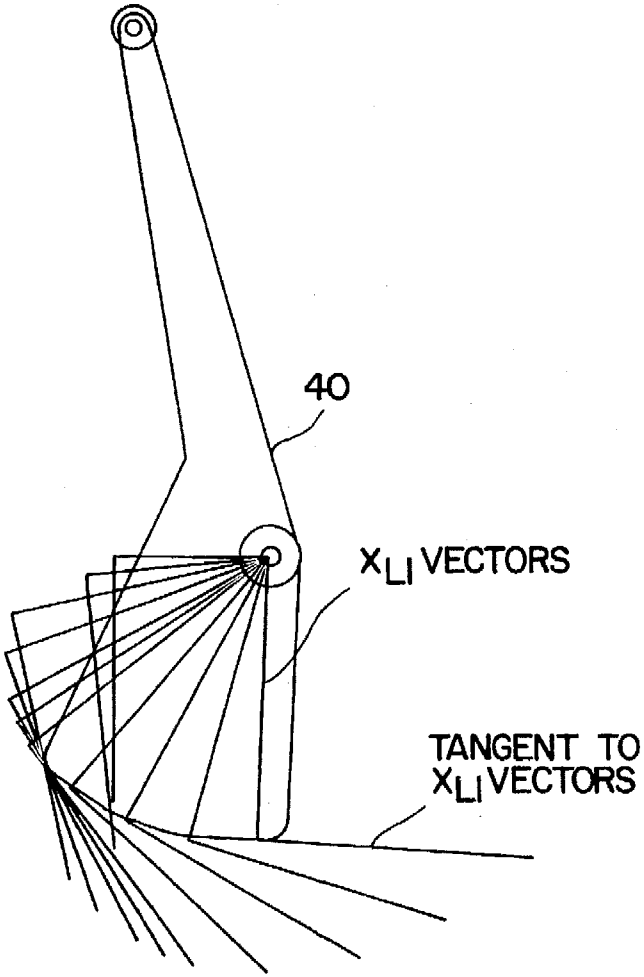

FIG. 8A illustrates the method of determining the shape of the cam pulley. Vectors of length $X_{L1}$ and direction $\theta_3$ are drawn about the moment arm pivot point. Tangent lines are drawn perpendicular to the outer ends of these vectors. The tangent lines depict the pulling direction of the counterweight cable when the cam has rotated into the angular position $\theta_3$ that corresponds to the lid open position θ. These tangent lines reveal the cam pulley shape and also indicate where a compromise is needed. Notice the upper two vectors have tangent lines passing through the body of the cam. Physically, the counterweight cable will be restricted from moving to those positions by the shape of the cam needed at lesser angles.

FIG. 8B illustrates how the effective length $X_{L1}$ is determined based on the cam shape and the desired length $X_{L1}$. The tangent line that falls within the body of the cam 13 is projected parallel to its desired position until it is tangent to the surface of the cam. The effective length $X_{L1}$ is the perpendicular distance from that tangent point to a line projected through the pivot point.

Figure 9A:
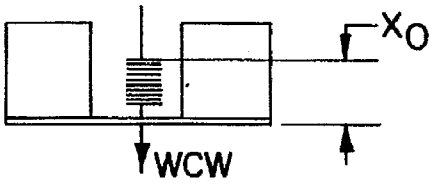
FIG. 9A–9D show four different operational positions of a spring means associated with the counterweight according to the present invention.
Figure 9B:
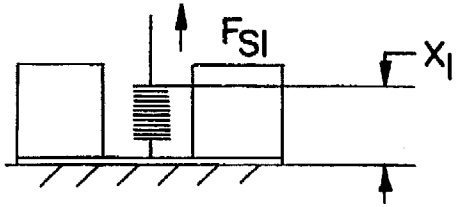
Figure 9C:
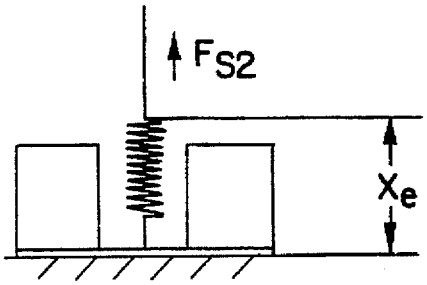
Figure 9D:
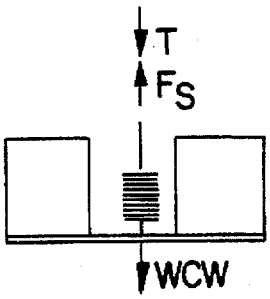

FIG. 9A illustrates the situation where the spring is fully compressed. This occurs when the counterweight is not resting on the platform. FIG. 9B illustrates what happens when the counterweight comes to rest upon the platform and the spring begins to decompress at approximately 80°. FIG. 9C shows the final position of the spring when the lid is at 90°. The spring extended further and $F_{S2}$ is reduced. Lastly, FIG. 9D shows that the spring force $F_S$ holds up portions of the counterweight $W_{CW}$ so that the net pull on the counterweight moment arm via the cable is: $T=W_{CW}-F_S$.

The following is an example of a cam pulley moment arm design for a 837 pound lid. A maximum hand force of 75 pounds is specified to pull the lid closed from the full open position. At open angles greater than 45° the lid should be self opening. And at open angles less than 45° the lid should be self closing. The length $L_3$ of first end of coupling is set at 26.75" and the radius L2 of the roller is set at 3.75". The lid length LL is set at about 48.4".

The following is a table that shows the result of designing a counterweight mechanism based on the above performance requirements, including calculating results and modifications needed for cam geometry compromise, and the resulting variation of hand force from the desired design requirements. Note that the counterweight ($W_{CW}$) is 800 lbs. except when resting on the platform as the lid angle of opening approaches 90°.

EX. 1 CAM PULLEY MOMENT ARM CALCULATION EXAMPLE

Design Requirements Calculation Results

| Lid Angle | Required Hand force | Geometry | | | Cam Shape Modifications | | | | Hand force Variation |
|---|---|---|---|---|---|---|---|---|---|
| θ | H | XL1 | θ3 | Wcw | XL1' | H' | H" | Wcw' | Des.-Req. |
| 0 | 35 | 15.7 | 17.96 | 800 | 15.70 | 35 | 35 | 800 | 0 |
| 10 | 30 | 16.4 | 31.8 | 800 | 16.40 | 30 | 30 | 800 | 0 |
| 20 | 25 | 16.85 | 44.7 | 800 | 16.85 | 25 | 25 | 800 | 0 |
| 30 | 15 | 17.2 | 56.75 | 800 | 17.25 | 15 | 15 | 800 | 0 |
| 40 | 5 | 17.2 | 67.57 | 800 | 17.24 | 4 | 4 | 800 | −1 |
| 45 | 0 | 17 | 72.5 | 800 | 17.05 | −1 | −1 | 800 | −1 |
| 50 | −10 | 16.9 | 77.2 | 800 | 16.77 | −8 | −8 | 800 | 2 |
| 60 | −25 | 15.9 | 85.7 | 800 | 15.95 | −25 | −25 | 800 | 0 |
| 70 | −60 | 15.5 | 93.1 | 800 | 14.98 | −53 | −53 | 800 | 7 |
| 80 | −75 | 12.4 | 99.6 | 800 | 13.92 | −90 | −70 | 625 | 5 |
| 90 | −75 | 6 | 105.3 | 800 | 12.86 | −135 | −70 | 320 | 5 |

Other Input

| | |
|---|---|
| $W_L$ | 837 |
| X | 10.8 |
| Y | 12 |
| L | 23.4 |
| Lh | 25 |
| T | 3 |
| L2 | 3.75 |
| L3 | 26.75 |

Figure 10:
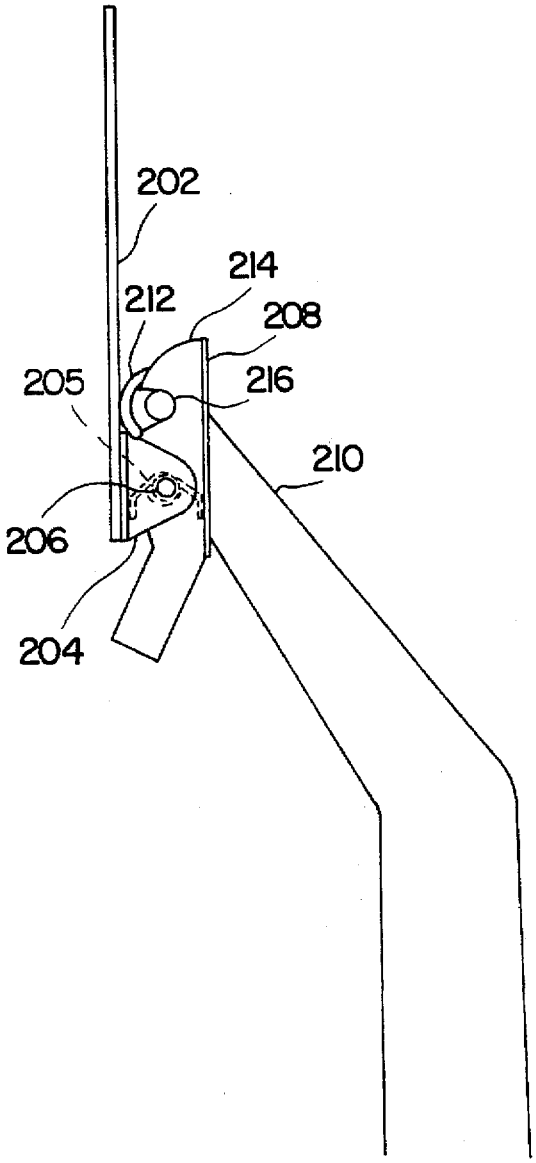
FIG. 10 shows an embodiment of a latch assembly according to the present invention.

FIG. 10 shows a latch assembly for releasably fixing lid 14 in a vertical position. FIG. 10 shows a portion 202 of the underlying surface of lid 14. A bracket 204 containing a pivot point 206 is attached to surface portion 202. A latch 208 is rotatably connected to pivot 206 of bracket 204.

FIG. 10 also shows a coupling means 210 and a roller 212 according to the present invention.

FIG. 10 shows the surface portion 202 when lid 14 is in a vertical position and as shown in FIG. 10, when the lid has reached a vertical position, roller 212 pushes past surface 214 of latch 208. Due to the force of gravity exerted on the lower portion of latch 208, concave surface 216 of latch 208, acting as a hook means, is forced towards surface portion 202 and closes around roller 212, acting as a catch means, thereby maintaining the lid in an open position. It will be recognized, that instead of the force of gravity exerted on latch 208, a spring may be connected to the lower portion of latch 208 and surface portion 202 such that the upper portion of latch 208 is forced toward surface portion 202. In such a case, as roller 212 pushes past surface 214, the spring is compressed until roller 212 reaches concave surface 216 at which point the spring again forces latch 208 toward surface portion 202, locking the lid into position.

In order to close the lid, the lower portion of latch 208 is pressed toward surface portion 202, thereby allowing roller 212 to move along surface portion 202 away from bracket 204.

It will be recognized by those skilled in the art that various changes and modifications to the above described embodiments may be made based on the present disclosure. Embodiments incorporating such changes and modifications are intended to be within the scope of the present invention.

The present invention has been described as having a spring-loaded counterweight means where the spring is used as a means for reducing the effective weight of the counterweight as the lid approaches a vertical position. Any other means for accomplishing this weight reduction may be used. For example, it will be recognized that multiple counterweights (or detached segments of a counterweight) may be hung from the flexible link at various distances from the coupling means. In such embodiments, as the lid is lifted, certain counterweights will come to rest on the platform earlier than others, thereby reducing the effective counterweight.

Various alterations, modifications, and adaptations may be made based on the present disclosure, and embodiments containing such alterations, modifications, and adaptations are intended to be within the scope of the present invention. It is to be understood that the present invention is not limited to the disclosed embodiments, but is intended to cover all modifications and equivalent arrangements including within the scope of the appended claims. Accordingly, it is appropriate that the appended claims be construed broadly and in a manner consistent with the spirit and scope of the invention herein.

What is claimed is:

1. A lid and counterweight assembly for a container having one or more walls and a floor, said lid positioned on top of said one or more walls and rotatable about a horizontal hinge axis, comprising:

counterweight means;

coupling means having a first end and a second end rotatable about a counterweight axis that is located between said first and second ends and within said container, said counterweight axis being parallel to said hinge axis, said first end of said coupling means slidably contacting the underlying surface of said lid such that, as said lid rotates about said hinge axis from a horizontal position toward a vertical position, the distance between the point of contact of said coupling means on said lid and said hinge axis is reduced; and means for connecting said counterweight means to said second end of said coupling means, said second end of said coupling means defining a cam surface, said means for connecting said counterweight means to said second end of said coupling means comprising flexible link means positioned on said cam surface so as to create a variable moment arm with respect to said counterweight axis for the force generated by said counterweight as a function of the angular position of said lid.

2. The lid and counterweight assembly of claim 1 wherein said second end of said coupling means defines a cam surface, and wherein said means for connecting said counterweight means to said second end of said coupling means comprises flexible link means, said flexible link means positioned on said cam surface such that the torque created by said counterweight at said counterweight axis varies as a function of the angular position of said coupling means about said axis.

3. The lid and counterweight assembly of claim 2 wherein said flexible link means comprises a cable.

4. The lid and counterweight assembly of claim 1 wherein said first end of said coupling means and said second end of said coupling means are connected in counter rotation with respect to one another about said counterweight axis.

5. The lid and counterweight assembly of claim 4 wherein said coupling means comprises first and second lever arms each having first and second ends, the first end of said first lever arm comprising said first end of said coupling means, the second end of said second lever arm comprising said second end of said coupling means, said second end of said first lever arm and said first end of said second lever arm including respective first and second gear means, and wherein said first gear means and said second gear means are in meshing engagement and comprise said counterweight axis.

6. The lid and counterweight assembly of claim 1 further comprising a second means for reducing the effective weight of said counterweight means as the position of said lid approaches said vertical position.

7. The lid and counterweight assembly of claim 6 wherein said reducing means comprises a platform positioned with respect to said counterweight means such that said counterweight means comes to rest on said platform when said lid angular position is between a predetermined point and said vertical position; and spring means coupled between said flexible link means and said counterweight means, said spring means being in a fully compressed state when said counterweight is not in contact with said platform and in an increasingly decompressed state as the position of said lid gets closer to said vertical position beyond said predetermined point.

8. The lid and counterweight assembly of claim 1 further comprising latch means, said latch means selectively causing said underlying surface of said lid to engage said first end of said coupling means, for releasably fixing said lid in said vertical position.

9. The lid and counterweight assembly of claim 8 wherein said latch means automatically engages said first end of said coupling means to said lid when said lid is moved to said vertical position.

10. The lid and counterweight assembly of claim 9 wherein said latch means engages said first end of said coupling means and said lid using the force of gravity.

11. The lid and counterweight assembly of claim 9 further including spring means, and wherein said latch means engages said first end of said coupling means and said lid by said spring means.

12. The lid and counterweight assembly of claim 8 wherein said latch means includes a hook means and a catch means, said catch means attached to said first end of said coupling means, said hook means attached to the underlying surface of said lid.

13. The lid and counterweight assembly of claim 12 wherein said first end of said coupling means includes a roller for contacting the underlying surface of said lid, said roller including an axle, said axle comprising said catch means.

14. A lid and counterweight assembly for a container having one or more walls and a floor, said lid positioned on top of said one or more walls and rotatable about a horizontal hinge axis, comprising:

counterweight means;

coupling means having a first end and a second end rotatable about a counterweight axis that is located between said first and second ends and within said container, said counterweight axis being parallel to said hinge axis, said first end of said coupling means slidably contacting the underlying surface of said lid such that, as said lid rotates about said hinge axis from a horizontal position toward a vertical position, the distance between the point of contact of said coupling means on said lid and said hinge axis is reduced; and means for connecting said counterweight means to said second end of said coupling means, wherein said second end of said coupling means defines a cam surface, and wherein said means for connecting said counterweight means to said second end of said coupling means comprises flexible link means, said flexible link means positioned on said cam surface so as to create a variable moment arm with respect to said counterweight axis for the force generated by said counterweight as a function of the angular position of the lid.

15. In a subsurface chamber below a surface across which aircraft travel and having at least one wall at the top of which an access lid capable of withstanding the weight of the tires of an aircraft moving across the lid is mounted on a hinge means for rotation about a horizontal lid axis, the improvement comprising a counterweight mechanism having:

counterweight means;

coupling means having a first end and a second end rotatable about a counterweight axis that is located between said first and second ends and within said chamber, said counterweight axis being parallel to said lid axis, said first end of said coupling means slidably contacting the underlying surface of said lid such that, as said lid rotates about said axis from a horizontal position toward a vertical position, the distance between the point of contact of said coupling means on said lid and said lid axis is reduced, said second end of said coupling means defining a cam surface; and means for connecting said counterweight means to said second end of said coupling means comprising flexible link means, said flexible link means positioned on said cam surface so as to create a variable moment arm with respect to said counterweight axis for the force generated by said counterweight as a function of the angular position of the lid.

16. The counterweight mechanism of claim 15, further comprising second means for reducing the effective weight of said counterweight means as the position of said lid approaches said vertical position.

* * * * *